US005924364A

United States Patent [19]

Grabley et al.

[11] Patent Number: 5,924,364

[45] Date of Patent: Jul. 20, 1999

[54] LASER-IMAGABLE RECORDING MATERIAL AND PRINTING PLATE PRODUCED THEREFROM FOR WATERLESS OFFSET PRINTING

[75] Inventors: Fritz-Feo Grabley, Königstein; Willi-Kurt Gries; Hans-Joachim Schlosser, both of Wiesbaden, all of Germany

[73] Assignee: Agfa-Gevaert N.V., Mortsel, Belgium

[21] Appl. No.: 09/008,249

[22] Filed: Jan. 16, 1998

Related U.S. Application Data

[60] Provisional application No. 60/047,045, May 19, 1997.

[30] Foreign Application Priority Data

Jan. 17, 1997 [EP] European Pat. Off. ..... 97200144

[51] Int. Cl.[6] ..... B41N 1/08; B41C 1/10

[52] U.S. Cl. ..... 101/457; 101/459; 101/467

[58] Field of Search ..... 101/453, 454, 101/457, 459, 463.1, 465, 466, 467; 430/303, 945

[56] References Cited

U.S. PATENT DOCUMENTS

| | | | |
|---|---|---|---|
| 3,559,576 | 2/1971 | Vrancken et al. | 101/467 |
| 4,063,949 | 12/1977 | Uhlig et al. | 101/467 |
| 5,339,737 | 8/1994 | Lewis et al. | 101/454 |
| 5,370,906 | 12/1994 | Dankert | 101/457 |
| 5,493,971 | 2/1996 | Lewis et al. | 101/457 |
| 5,634,403 | 6/1997 | Williams et al. | 101/454 |
| 5,783,364 | 7/1998 | Ellis et al. | 101/467 |
| 5,786,129 | 7/1998 | Ellis | 101/457 |

FOREIGN PATENT DOCUMENTS

| | | |
|---|---|---|
| 25 12 038 | 10/1975 | Germany . |
| 94/01280 | 1/1994 | WIPO . |

OTHER PUBLICATIONS

"Patent Abstract of Japan" 03059558 vol. 15 No. 214 p. 1209 Mar. 14, 1991.

*Primary Examiner*—Stephen R. Funk
*Attorney, Agent, or Firm*—Foley & Lardner

[57] ABSTRACT

The invention relates to a recording material having a plate- or sheet-like substrate, at least one IR-absorbing layer, which comprises at least one IR-absorbing component and at least one polymeric, organic binder and decomposes under the action of IR laser radiation or changes so that its adhesion to the silicone top layer decreases, and a top layer comprising a cured silicone rubber. The substrate comprises an oxidizable metal or one of its alloys and, at least on the side facing the IR-absorbing layer, is roughened and is covered with a layer of an oxide of the metal. The invention also relates to a process for the production of a waterless offset printing plate and to the printing plate itself which is produced from the recording material according to the invention and in which the hydrophilic surface of the oxide layer is ink-carrying and the oleophobic top layer is ink-repellent.

14 Claims, No Drawings

LASER-IMAGABLE RECORDING MATERIAL AND PRINTING PLATE PRODUCED THEREFROM FOR WATERLESS OFFSET PRINTING

This application claims priority from provisional application Ser. No. 60/074,045 filed on May 19, 1997.

FIELD OF THE INVENTION

The invention relates to a recording material having a plate- or sheet-like substrate, a top layer comprising a cured silicone rubber and at least one IR-absorbing layer, which comprises at least one IR-absorbing component and at least one polymeric, organic binder and decomposes under the action of IR laser radiation or changes so that its adhesion to the silicone top layer decreases. It can be provided with an image by means of laser radiation and serves primarily for the production of offset printing plates which print by a waterless method.

BACKGROUND OF THE INVENTION

Recording materials for waterless lithographic printing, where a laser-sensitive layer is removed, are already known. Thus, DE-A 25 12 038 describes a material which consists of a substrate, an intermediate layer which contains particles absorbing laser energy (in particular carbon black), nitrocellulose and a crosslinking agent, and a silicone rubber layer. Aluminum, paper and plastic are mentioned as substrates. To prevent the heat generated by the laser from being conducted away by the aluminum, the aluminum surface is preferably provided with an insulating layer of an oleophilic resin. The plate is exposed to infrared or visible laser radiation, preferably from an Nd-YAG laser or an argon laser. In the parts which the radiation strikes, the intermediate layer is oxidized and combusted. Consequently, the silicone layer present on top becomes detached and can be removed with an organic solvent. However, the recording material has only relatively little sensitivity. Moreover, the plates produced therefrom permit only a short print run.

EP-A 573 091 and EP-A 685 333 likewise describe a material for the production of waterless offset printing plates. Once again, it comprises a substrate having an oleophilic surface, a recording layer which is applied thereon, is not more than 3 $\mu$m thick and contains a substance which converts radiation into heat, and a cured silicone layer. The substrates used are generally films of polyester, polycarbonate or polystyrene. Polyolefin-coated paper is also suitable. Aluminum substrates are also mentioned; however, these must be provided with a special oleophilic coating. Carbon black and pigments and dyes which absorb in the infrared range are mentioned as substances which convert radiation into heat. The recording layer may also comprise a metal, e.g. bismuth, tin or tellurium, applied by vapour deposition. This metal layer is not more than 25 nm thick. The recording material is provided with an image by means of laser radiation and is then rubbed dry. During this procedure, the irradiated parts of the recording layer are removed together with the silicone layer present on top. Offset printing plates having a polyester substrate permit only relatively short runs in generally small-size, low-speed printing presses. The potential uses of such printing plates are therefore greatly restricted.

EP-A 580 393 discloses, inter alia, a three-layer recording material for the production of waterless offset printing plates. It comprises in general a substrate which reflects IR radiation, for example a substrate of degreased, bright-rolled aluminum or a polyester film, on which a reflecting aluminum layer has been applied by vacuum vapour deposition or by sputtering. An IR-absorbing layer and a silicone top layer are then applied to this substrate. The IR-absorbing layer is removed by imagewise exposure to laser radiation of appropriate wavelength. Consequently, those parts of the silicone layer which are present on top become detached and can be removed mechanically, for example by means of brushing. The metallic or metallized substrate has only little affinity to water. The disadvantage of such a recording material is once again the low adhesion between the substrate and the layer present on top. A printing plate produced therefrom accordingly gives only a short print run.

According to EP-A 644 047, a further layer which itself does not absorb laser radiation but, under the action of laser radiation on the IR-absorbing layer present on top, undergoes thermal decomposition with formation of gaseous products is arranged between the substrate and the IR-absorbing layer. The thickness of this further layer is chosen so that it undergoes only partial decomposition. In general, it is from 1 to 30 $\mu$m thick. An adhesion-promoting layer, for example a layer of a silane or a protein, may also be arranged between substrate and thermally decomposable layer.

SUMMARY OF THE INVENTION

It is therefore an object of the present invention to provide recording materials from which printing plates for waterless lithographic printing which have high sensitivity to infrared laser radiation and high resolution can be produced in a simple manner.

It is therefore a further object of the present invention to provide a printing plate which achieves a long print run.

According to the present invention there is provided a recording material having a plate- or sheet-like substrate, a top layer comprising a cured silicone rubber, and at least one IR-absorbing layer which comprises at least one IR-absorbing component and at least one polymeric, organic binder and decomposes under the action of IR laser radiation or changes so that its adhesion to the silicone top layer decreases, which is characterized in that the substrate comprises an oxidizable metal or one of its alloys and, at least on the side facing the IR-absorbing layer, is roughened and is covered with a layer of an oxide of the metal.

DETAILED DESCRIPTION OF THE INVENTION

The substrate preferably consists of aluminum or one of its alloys. It is in general mechanically, chemically and/or electrochemically roughened. This roughening can be achieved by dry brushing, wet brushing, sand-blasting, chemical treatment and/or electrochemical treatment. The electrochemical roughening is preferred. It leads to outstanding anchoring of the IR-absorbing layer on top. The average peak-to-valley height $R_z$ (determined according to DIN 4768—October 1970 edition) of the surface is in the range from about 0.5 to 15 $\mu$m.

Suitable roughening methods are also described in EP-A 292 801, EP-A 437 761 and DE-A 33 05 067. The metallic substrate generally has high thermal conductivity. Its surface area increases owing to the roughening, with the result that the heat induced by the laser radiation can be removed even more rapidly. On the other hand, the metal oxide layer has a heat-insulating action and substantially slows down the loss of heat. The layer comprising the metal oxide, especially alumina, has in general only 1/10 or less of the thermal conductivity of the respective metal. The oxide is preferably produced electrochemically directly from the metal of the substrate. Particularly in the case of aluminum substrates, the electrochemical oxidation can be controlled so that pores form in the oxide layer and even further reduce the thermal conductivity. The production of such oxide layers is generally known and described (for example in EP-A 161 461). As a result of the metal oxide layer, a hydrophilic, abrasion-resistant surface is produced on the substrate. Depending on the process parameters, the weight of the oxide layer is in general from 0.5 to 10 g/m$^2$, preferably from 1 to 5 g/m$^2$. The surface obtained by the combination of roughening and oxidation reflects the IR laser radiation to a substantially lesser extent so that excellent reproduction of fine image elements and hence high resolution are ensured. The surface of the metal oxide layer is hydrophilic. Surprisingly, this hydrophilic surface shows excellent ink acceptance during subsequent printing. The prior art had suggested that only an oleophilic surface meets this requirement. The waterless offset printing plates produced from the recording material according to the invention give prints of excellent quality. The achievable print run is long; in general, it is more than 100,000 prints.

The IR-absorbing layer contains components, in particular pigments or dyes, which absorb laser radiation having a wavelength in the infrared range (especially in the range from 700 to 1200 nm). Here, the pigments are also to include carbon black. Suitable IR absorbers are mentioned in J. Fabian et al., Chem. Rev. 92 [1992] 1197. Pigments which contain metals, metal oxides, metal sulphides, metal carbides or similar metal compounds are also suitable. Finely divided metallic elements of main groups II to V and of subgroups I, II and IV to VIII of the Periodic Table, such as Mg, Al, Bi, Sn, In, Zn, Ti, Cr, Mo, W, Co, Ir, Ni, Pd, Pt, Cu, Ag, Au, Zr or Te, are preferred. Other suitable IR-absorbing components are metal-phthalocyanine compounds, anthraquinones, polythiophenes, polyanilines, polyacetylenes, polyphenylenes, polyphenylene sulphides and polypyrroles. In order to avoid unnecessarily impairing the resolution, the absorbing pigment particles should have a mean diameter of, as far as possible, not more than 30 $\mu$m. The amount of the IR-absorbing component is in general from 2 to 80% by weight, preferably from 5 to 57% by weight, based in each case on the total weight of the nonvolatile components of the layer. The IR-absorbing layer furthermore contains at least one polymeric, organic binder. Binders which undergo spontaneous decomposition under the action of heat are particularly advantageous. These binders undergoing autoxidation include in particular nitrocellulose. Polymers which do not undergo autoxidation and which undergo thermally induced decomposition indirectly with the formation of gaseous or volatile cleavage products may also be used. Examples of these are ethylcellulose, (meth)acrylate polymers and copolymers (such as poly (methyl methacrylate), poly(butyl acrylate), poly(2-hydroxyethyl methacrylate), copolymers of lauryl acrylate and methacrylic acid, polystyrene, poly(methylstyrene), copolymers of vinyl chloride and vinyl acetate, polyurethanes, polycarbonates and polysulphones. The directly or indirectly thermally decomposable polymers are not required in every case, so that other film-forming polymers may also be used. This applies when the IR-absorbing component already forms sufficiently volatile products under irradiation. For example, carbon black undergoes combustion when IR laser radiation strikes it, and accordingly gives gaseous combustion products. The "other film-forming polymers" are in particular homo- and copolymers containing units of (meth)acrylic acid, (meth)acrylates and/or (meth)acrylamides, as well as polyvinyl acetates and polyvinyl acetals, which, if appropriate, are furthermore modified with carboxyl groups. They are used either in combination with the thermally decomposable materials or alone. The amount of the binders is in general from about 20 to 95% by weight, preferably from 30 to 80% by weight, based in each case on the total weight of the nonvolatile components of the layer.

In addition, the layer may also contain compounds which crosslink the binder. The type of crosslinking agent depends on the chemical functionality of the binder (S. Paul, Crosslinking Chemistry of Surface Coatings in Comprehensive Polymer Science, Volume 6, Chapter 6, page 149). The amount of the crosslinking agent or agents is in general from 0 to 30% by weight, preferably from 3 to 20% by weight, particularly preferably from 5 to 15% by weight, based in each case on the total weight of the nonvolatile components of the layer.

The IR-absorbing layer may moreover contain compounds which undergo decomposition under the action of heat and/or IR radiation or by chemical induction and form chemically active species (in particular acids), which in turn cause cleavage or decomposition of the polymeric, organic binder. Once again, volatile cleavage or decomposition products are formed. Binders which contain tert-butoxycarbonyl groups give, for example, $CO_2$ and isobutene when acid acts thereon. Furthermore, the layer may contain compounds which form low molecular weight, gaseous or at least volatile cleavage products (Encycl. Polym. Sci. Eng., Vol. 2, page 434). Examples of such compounds are diazonium salts, azides, bicarbonates and azobicarbonates. The IR-absorbing layer can in addition contain stabilizers for increasing the storability, plasticizers, catalysts for initiating the crosslinking reaction, dulling agents, additional dyes, surfactants, levelling agents or other auxiliaries for improving stability, processing or reprographic quality. The amount of these additives is in general from 0 to 50% by weight, preferably from 10 to 30% by weight, based in each case on the weight of the nonvolatile components of the layer.

The weight of the IR-absorbing layer is in general from 0.15 to 5 g/m$^2$, preferably from 0.5 to 3.5 g/m$^2$. The IR-absorbing layer is produced by applying and drying an appropriate coating solution. Suitable solvents for the preparation of the coating solution include ketones, esters, glycol ethers, alcohols, ethers or mixtures thereof.

The silicone top layer is oleophobic and repels the ink during printing. It consists of crosslinked silicone rubber. Any silicone rubber which is sufficiently ink-repellent to permit printing without damping solution is in principle suitable. The term "silicone rubber" is intended to be understood as meaning a high molecular weight, essentially linear diorganopolysiloxane, in accordance with the definition of Noll "Chemie und Technologie der Silikone" [Chemistry and Technology of the Silicones], Verlag Chemie [1968], page 332. For the crosslinked or vulcanized products, on the other hand, the term "vulcanized silicone rubber" is used. In general, a solution of silicone rubber is applied to the IR-absorbing layer, dried and crosslinked. Particularly suitable solvents are toluene, xylene and in particular isoparaffins (boiling range from 100 to 180° C.).

The silicone rubbers may be one-component or multi-component rubbers. Examples are described in DE-A 23 50 211, 23 57 871 and 23 59 101. Particularly suitable one-component silicone rubbers are polydimethylsiloxanes which carry hydrogen atoms, acetyl, oxime, alkoxy or amino groups or other functional groups at the chain ends. The methyl groups in the chain may also be replaced by other alkyl groups, by haloalkyl groups or by unsubstituted or substituted aryl groups (in particular phenyl groups). The terminal functional groups are readily hydrolysable and cure in a short time (from a few minutes to a few hours) in the presence of moisture. The multicomponent silicone rubbers are crosslinkable by addition or condensation. The addition-crosslinkable types contain in general two different polysiloxanes. One polysiloxane is generally present in an amount of from 70 to 99% by weight and has alkylene groups (in particular vinyl groups). The other is present in general in an amount of from 1 to 10% by weight. In this polysiloxane, hydrogen atoms are bonded directly to silicon atoms. The addition reaction is effected by heating to more than 50° C. in the presence of from about 0.0005 to 0.002% by weight of a platinum catalyst. Multicomponent silicone rubbers have the advantage that they crosslink very rapidly at relatively high temperature (about 100° C.). The time within which they can be processed, the so-called "pot life", is on the other hand often relatively short. The condensation-crosslinkable mixtures contain diorganopolysiloxanes having reactive terminal groups, such as hydroxyl and acetoxy groups. These are crosslinked with silanes or oligosilanes in the presence of catalysts. Crosslinking agents are present in an amount of from 2 to 15% by weight, while the catalysts are present in an amount of from 0.01 to 10% by weight, based in each case on the total weight of the nonvolatile components of the layer. These mixtures, too, react relatively rapidly and therefore have only a limited pot life.

A particularly preferred mixture consists of hydroxyl-terminated polydimethylsiloxanes, a silane crosslinking component (in particular a tetra- or trifunctional alkoxy-, acetoxy-, amido-, amino-, aminoxy-, ketoximino- or enoxysilane) or functionalized silicone resins, a crosslinking catalyst (in particular an organotin or organotitanium compound) and if appropriate, further components, such as
organopolysiloxane compounds having Si-H bonds,
platinum catalysts for further addition crosslinking,
silanes having adhesion-improving properties,
reaction inhibitors,
fillers and/or dyes.

The stated silane crosslinking components and the reactions occurring during the crosslinking are described by J. J. Lebrun and H. Porte in "Comprehensive Polymer Science", Vol. 5 [1989] 593–609.

The silicone layer may contain further components. These may serve for additional crosslinking, better adhesion, mechanical strengthening or colouring. These further components which are only optionally present may be present in an amount of not more than 10% by weight, preferably not more than 5% by weight, based in each case on the total weight of the layer.

After coating with the silicone rubber solution and drying, crosslinking ("curing") to give a vulcanized silicone rubber is carried out in a manner known per se by the action of moisture or spontaneously at room temperature or elevated temperature. The cured silicone rubber layer is virtually insoluble in organic solvents. It is transparent for the IR laser radiation and itself absorbs virtually no IR radiation (compounds with which the silicone layer may be colored must therefore be appropriately chosen). The weight of the cured silicone layer is in general from 1 to 20 g/m$^2$, preferably from 1 to 5 g/m$^2$, which corresponds approximately to a thickness of from 0.8 to 17 $\mu$m, preferably from 0.8 to 4 $\mu$m.

The printing plates are produced by imagewise exposure to IR laser radiation. YAG lasers, Nd-YAG lasers, argon lasers, semiconductor lasers and laser diodes, each of which emit radiation in the IR range, are preferred. They generally have an output power of between 40 and 7500 mW. The radiation energy is in general from 20 to 600 mJ/cm$^2$. As low a radiation energy as possible is desirable. The laser radiation results in ablation of the IR-absorbing layer, with the result that at the same time the oleophobic silicone layer becomes detached and is simultaneously removed. Loosely adhering layer components can be removed mechanically (for example by wiping), if appropriate with a suitable solvent. The printing plates can be produced in this manner in a single step. A further advantage is that only a very small amount of liquid waste products, if any, are obtained.

The present invention thus also relates to a process for the production of a waterless offset printing plate, which is characterized in that IR laser radiation is allowed to act imagewise on the recording material according to the invention. In the case of the waterless offset printing plate thus produced, the hydrophilic surface of the oxide layer is ink-carrying and the oleophobic top layer is ink-repellent.

The present invention finally also relates to the printing plate produced from the recording material according to the invention.

The examples which follow illustrate the invention. Therein, pbw represents part by weight. Unless stated otherwise, "%" represents "% by weight".

EXAMPLE 1

A 0.3 mm thick, electrolytically roughened and anodically oxidized aluminum plate having an oxide weight of 3.6 g/m$^2$ was rendered hydrophilic with a 0.1% by weight aqueous polyvinylphosphonic acid solution. A solution of 44.4 pbw of a 20% by weight ®EFWEKO NC 118 solution (Degussa AG), which consists of

| | |
|---|---|
| 18.0 pbw | of High-Color-Channel (HCC) carbon black, |
| 28.0 pbw | of collodium wool of standard type 24 E, |
| 28.0 pbw | of collodium wool of standard type 27 E, |
| 22.0 pbw | of dibutyl phthalate and |
| 4.0 pbw | of the copper salt of 2-ethylhexanoic acid in propylene glycol methyl ether acetate, |
| 7.88 pbw | of a 20% by weight solution of a mixture of diphenylmethane 4,4'-diisocyanate and polymeric components (® DESMODUR VKS) and |
| 4.20 pbw | of a 1% by weight solution of silicone oil in butan-2-one in a mixture of |
| 73.2 pbw | of butan-2-one and |
| 20.3 pbw | of propylene glycol methyl ether acetate (PGMEA) |

was applied to this substrate and then dried for 2 min at 120° C. The weight of the resulting layer was 3.0 g/m$^2$.

| A solution of | |
|---|---|
| 33.5 pbw | of a 33% by weight solution of polydimethylsiloxanes containing hydroxyl groups in toluene (viscosity 9,000–15,000 mPa · s at 25° C., Wacker ® DEHESIVE 810), |

-continued

| A solution of | |
|---|---|
| 1.56 pbw | of a 50% by weight solution of silicone resin having aminoalkyl groups in toluene (Wacker V 83) and |
| 0.67 pbw | of dibutyltin diacetate in |

214 pbw of isoparaffin (initial boiling point 118° C.) was then applied to the IR absorber layer and thereafter dried for 2 min at 120° C. with circulating air. The weight of the silicone layer was then 2.3 g/m$^2$.

The recording material thus produced was mounted on a uniformly driveable drum and recorded on by means of a continuously operating Nd-YAG laser (200 mW output power at 1064 nm) with a resolution of 1200 dpi. The exposure time, which was variable by changing the rotational speed of the drum, was set at 15 $\mu$s per pixel. This corresponds to an energy of about 500 mJ/cm$^2$. The material on which various line patterns are recorded is wiped with a 1% strength by weight surfactant solution (e.g. ®GLUCOPON 600 CS UP, Henkel) to remove the ablated material and is used for printing under the conditions usual for waterless offset. Well over 100,000 prints of excellent quality can be produced. The printing capacity is accordingly well above the usual prior art (in this context, cf. Seybold Report Vol. 24, No. 15–14 April, 1995, and Paper presented at New Era: A Technical Conference for the Printing Industry, held at Sutton Coldfield, UK, Mar. 16, 1994, 17 pages).

EXAMPLES 2 to 10

A 0.2 mm thick, electrolytically roughened and anodically oxidized aluminum plate having an oxide weight of 3.4 g/m$^2$ was rendered hydrophilic with a 0.1% by weight aqueous polyvinylphosphonic acid solution. Coating solutions are prepared with the components stated in Table 1 and are applied, as described in Example 1, to this substrate type and dried.

TABLE 1

| | Components for layers absorbing IR radiation | | | | | | | | |
|---|---|---|---|---|---|---|---|---|---|
| Component | 2 | 3 | 4 | 5 | 6 | 7 | 8 | 9 | 10 |
| Carbon black A[1)] | 11.8 | — | — | — | — | 9.93 | 9.41 | 9.39 | 9.30 |
| Carbon black B[2)] | — | 7.05 | — | — | — | — | — | — | — |
| Carbon black C[3)] | — | — | 4.58 | — | — | — | — | — | — |
| Carbon black D[4)] | — | — | — | 7.25 | 15.0 | — | — | — | — |
| VP-N-3108[5)] | — | — | 5.25 | 6.78 | — | — | — | — | — |
| Carboset 526[6)] | — | — | — | — | 3.57 | — | — | — | — |
| Cymel 301[7)] (20% MEK) | 3.13 | 1.88 | 2.63 | 2.63 | 2.63 | — | — | — | 2.63 |
| Desmodur VKS[8)] (20% MEK) | — | — | — | — | — | — | 5.25 | — | — |
| Desmodur VK[9)] (20% MEK) | — | — | — | — | — | 2.63 | — | — | — |
| Silane Z-6124[10)] | — | — | — | — | — | — | — | — | 0.53 |
| EP 140[11)] (20% MEK) | — | — | — | — | — | — | — | 5.25 | — |
| pTosOH[12)] (10% MEK) | 1.25 | 0.79 | 1.05 | 1.05 | 1.05 | — | — | — | 1.05 |
| DABCO[13)] (10% MEK) | — | — | — | — | — | — | — | 0.21 | — |
| Silicone oil (1% MEK) | — | — | 4.20 | 4.20 | — | 4.20 | 4.20 | 4.20 | 4.20 |
| Ethyl acetate | 232 | 140 | — | — | 128 | — | — | — | — |
| Butyl acetate | 1.66 | 1.00 | — | — | — | — | — | — | — |
| 2-Butanone | — | — | 76.5 | 76.5 | — | 77.4 | 75.3 | 75.2 | 76.5 |
| Propylene glycol methyl ether acetate | — | — | 55.8 | 51.6 | — | 55.8 | 55.8 | 55.8 | 37.2 |
| Layer weight [g/m$^2$] | 1.6 | 2.2 | 4.1 | 3.9 | 3.0 | 2.8 | 2.2 | 2.6 | 2.4 |

[1)]Nitrocellulose chips (Degussa, Efweko NC 118/2)
[2)]Nitrocellulose pigment preparation (Hagedorn 71907)
[3)]Nitrocellulose pigment preparation (Hagedorn 70907)
[4)]Paste with acrylate binder containing OH groups (Degussa, Syn 12/200)
[5)]Nitrocellulose chips plasticized with 18% of epoxidized soybean oil (Wolff Walsrode)
[6)]Polyacrylate resin (BF Goodrich)
[7)]Melamine resin (Dyno Cyanamid)
[8), 9)]Liquid polyisocyanates (Bayer)
[10)]Phenyltrimethoxysilane (Dow Corning)
[11)]Epoxy resin (® BECKOPOX from Vianova Resins GmbH)
[12)]p-Toluenesulphonic acid
[13)]Diazabicyclooctane The silicone rubber described in Example 1 is applied to the various IR absorber layers. The resulting printing plates are provided with an image analogously to Example 1, processed and used for printing.

EXAMPLES 11 to 19

An IR absorber layer is produced similarly to Example 1, covered with the silicone coating solutions shown in Table 2 and dried for 2 minutes at 120° C. The resulting layer weights are likewise listed in Table 2.

TABLE 2

| | Components for silicone layers | | | | | | | | |
|---|---|---|---|---|---|---|---|---|---|
| Component | 11 | 12 | 13 | 14 | 15 | 16 | 17 | 18 | 19 |
| Polymer[1)] | 18.8 | 17.7 | 17.7 | — | 19.9 | — | — | — | — |
| Polymer[2)] | — | — | — | 13.3 | — | — | — | — | — |
| Polymer[3)] | — | — | — | — | — | 19.4 | — | — | — |
| Polymer[4)] | — | — | — | — | — | — | 9.46 | — | — |
| Polymer[5)] | — | — | — | — | — | — | — | 8.59 | 8.41 |
| V 83[6)] | 0.88 | 0.88 | 0.88 | 0.94 | — | — | — | — | — |
| Tetra(2-methoxy-ethanol)-silane | — | — | — | — | 0.04 | — | — | — | — |
| V 93[7)] | — | — | — | — | — | 2.33 | — | | — |
| V 24[8)] | — | — | — | — | — | — | 0.24 | | — |
| Ethyltri-acetoxysilane | — | — | — | — | — | — | — | 0.32 | — |
| Methyltris-(methylethyl-ketoximino)-silane | — | — | — | — | — | — | — | — | 0.32 |
| Dibutyltin diacetate | 0.37 | 0.37 | 0.37 | 0.40 | 0.20 | — | — | 0.001 | 0.01 |
| OL[9)] | — | — | — | — | — | 0.06 | 0.10 | | — |
| GF 91[10)] | — | 0.35 | — | — | — | — | — | | 0.27 |
| HF 86[11)] | — | — | 0.35 | — | — | — | 0.20 | | — |
| Iso-paraffin[12)] | 80.0 | 80.7 | 80.7 | 85.3 | 79.8 | 78.2 | — | 91.0 | 91.0 |
| Layer weight [g/m$^2$] | 4.3 | 4.1 | 4.3 | 2.8 | 3.8 | 2.9 | 2.1 | 2.5 | 2.3 |

[1)]33% by weight solution of polydimethyisiloxanes containing hydroxyl groups in toluene (viscosity 9,000–15,000 mPa · s at 25° C., Wacker Dehesive 810)
[2)]50% by weight solution of polydimethylsiloxanes containing hydroxyl groups in toluene (viscosity 9,000–15,000 mPa · s at 25° C., Wacker Dehesive 850)
[3)]30% by weight solution of polydimethylsiloxanes containing vinyl groups in naphtha, boiling range 80–110° C. (viscosity 6,000–10,000 mPa · s at 25° C., Wacker Dehesive 940)
[4)]Polydimethylsiloxanes containing vinyl groups (viscosity 400–600 mPa · s, Wacker Dehesive 920)
[5)]Hydroxyl-terminated polydimethylsiloxanes (viscosity about 45,000 mPa · s, Bayer ® SILOPREN E 50)
[6)]50% by weight solution of a silicone resin having aminoalkyl groups in toluene (Wacker)
[7)]5% by weight solution of a polyhydrogenomethylsiloxane in naphtha of boiling range 80–110° C. (Wacker)
[8)]Polyhydrogenomethylsiloxane (viscosity 15–30 mPa · s at 25° C., Wacker)
[9)]1% by weight solution of a platinum complex preparation in polydimethylsiloxane (Wacker)
[10)][3-(2-Aminoethylamino)propyl] trimethoxysilane (Wacker)
[11)]Silane mixture comprising triacetoxyvinylsilane and trimethoxy (3-oxiranylmethoxypropyl)silane (Wacker)
[12)]Initial boiling point 118° C.

The further processing of the printing plates is carried out as described in Example 1.

We claim:

1. Recording material comprising a plate or sheet substrate, a top layer comprising a cured silicone rubber, and at least one IR-absorbing layer which comprises at least one IR-absorbing component and at least one polymeric, organic binder and decomposes under the action of IR laser radiation or changes so that its adhesion to the silicone top layer decreases, and wherein the substrate comprises an oxidizable metal or one of its alloys and, at least on a side facing the IR-absorbing layer, is roughened and is covered with a layer of an oxide of the metal.

2. Recording material according to claim 1, wherein the substrate is mechanically, chemically and/or electrochemically roughened.

3. Recording material according to claim 1, wherein the layer of the oxide is produced electrochemically.

4. Recording material according to claim 3, wherein the oxide layer is porous.

5. Recording material according to claim 1, wherein the weight of the oxide layer is from 0.5 to 10 g/m$^2$.

6. Recording material according to claim 5, wherein the weight of the oxide layer is from 1 to 5 g/m$^2$.

7. Recording material according to claim 1, wherein the IR-absorbing component is a pigment, a dye, a metallic element or carbon black.

8. Recording material according to claim 1, wherein the IR-absorbing layer contains a directly or indirectly thermally decomposable binder.

9. Recording material according to claim 8, wherein the directly thermally decomposable binder is nitrocellulose.

10. Recording material according to claim 1, wherein the weight of the IR-absorbing layer is from 0.15 to 5 $g/m^2$.

11. Recording material according to claim 10, wherein the weight of the IR-absorbing layer is from 0.5 to 3.5 $g/m^2$.

12. A process for the production of a waterless offset printing plate, comprising:

allowing IR laser radiation to act imagewise on the recording material according to claim 1 and removing parts of the IR-absorbing layer struck by the radiation together with parts of the top layer which are present on top.

13. A process according to claim 12, wherein any adhering loose parts of the IR recording layer are removed mechanically.

14. A Waterless offset printing plate, that is produced from a recording material prepared according to claim 12.

* * * * *